US005547805A

United States Patent [19]

Hazama et al.

[11] Patent Number: 5,547,805

[45] Date of Patent: Aug. 20, 1996

[54] ELECTROPHOTOGRAPHIC METHOD USING AMORPHOUS SILICON PHOTOSENSITIVE MATERIAL

[75] Inventors: Hiroyuki Hazama; Masahiro Tsutsumi; Masaru Watanabe, all of Osaka, Japan

[73] Assignee: Mita Industrial Co., Ltd., Osaka, Japan

[21] Appl. No.: 427,174

[22] Filed: Apr. 24, 1995

[30] Foreign Application Priority Data

Apr. 28, 1994 [JP] Japan ..... 6-091705

[51] Int. Cl.[6] ..... G03G 13/22

[52] U.S. Cl. ..... 430/125; 430/97; 430/120; 430/126

[58] Field of Search ..... 430/125, 126, 430/120

[56] References Cited

U.S. PATENT DOCUMENTS 4,764,448 8/1988 Yoshitomi et al. ..... 430/120

*Primary Examiner*—Roland Martin
*Attorney, Agent, or Firm*—Sherman and Shalloway

[57] ABSTRACT

More than 100,000 pieces of copy are obtained, in an electrophotographic process using an amorphous silicon photosensitive material, by maintaining the atmosphere for the photosensitive material and effecting the developing and polishing of the surface of the photosensitive material in a manner such that X, the degree of surface oxidation of the amorphous silicon photosensitive material (SiO/SiC), and Y, the amount of deposition of discharge products (mol/cm$^2$), satisfy the relationships (1) and (2);

$$0.4 \leqq x \leqq 1.25 \quad (1)$$

$$Y \leqq 2.2\times10^{-9}.\exp(-2.0\,x) \quad (2)$$

By this method, image flow is prevented without permitting the life of the photosensitive material to decrease, and an image can be stably formed for extended periods of time.

2 Claims, 4 Drawing Sheets

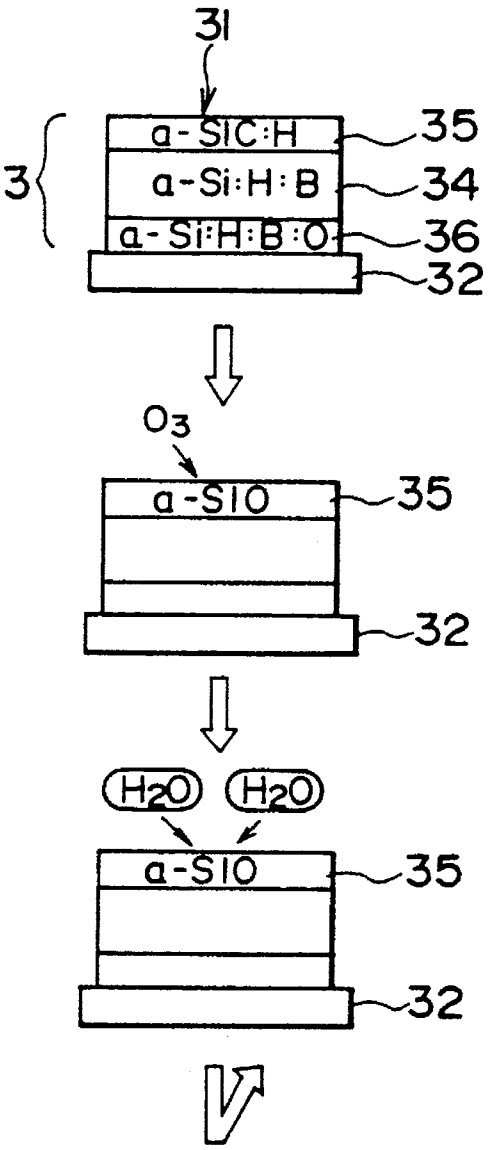
FIG.1(A)
FIG.1(B)
FIG.1(C)
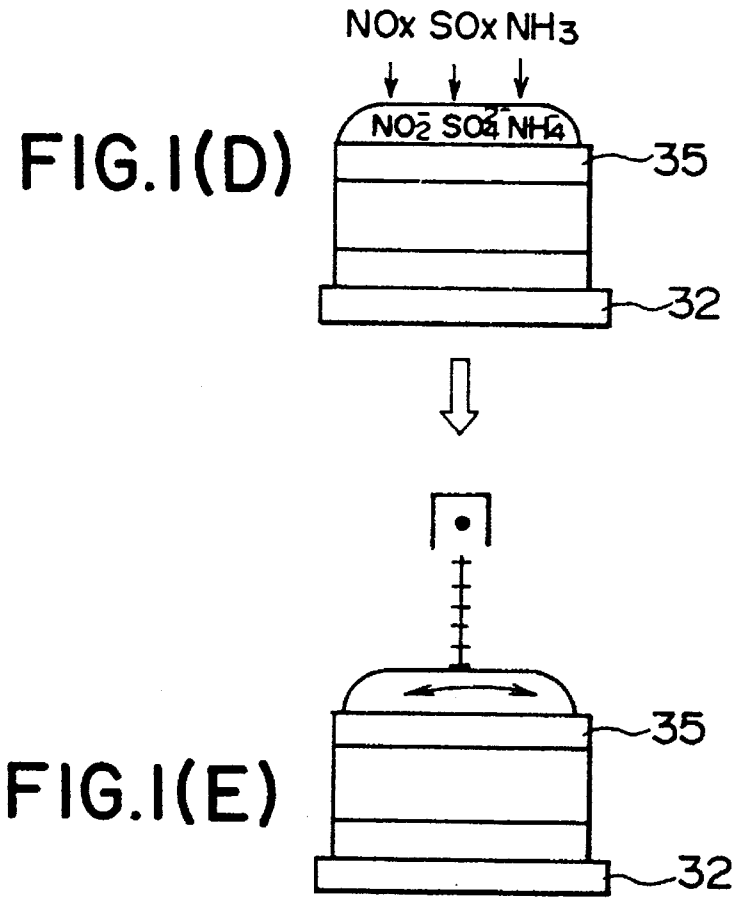
FIG.1(D)
FIG.1(E)

ELECTROPHOTOGRAPHIC METHOD USING AMORPHOUS SILICON PHOTOSENSITIVE MATERIAL

BACKGROUND OF THE INVENTION

1. Field of the Invention

The present invention relates to an electrophotographic method using an amorphous silicon photosensitive material. More particularly, the invention relates to an electrophotographic method which enables the life of the photosensitive material to be lengthened without permitting image to flow and makes it possible to stably obtain image for extended periods of time.

2. Description of the Prior Art

An amorphous silicon photosensitive material has been extensively used for electrophotography. The amorphous silicon (a-Si) photosensitive material exhibits high sensitivity on the side of long wavelengths and further gives such advantages as excellent surface rigidity and abrasion resistance.

In the case of a copying machine using the amorphous silicon photosensitive material, however, the surface of the photosensitive material is oxidized and tends to absorb moisture after the photosensitive material is repetitively used. As a result, the surface resistance decreases, the surface charge migrates in the transverse direction and the image flows. To cope with this, it has been attempted to scrape off the oxidized portions on the photosensitive material surfaces and to exhaust ozone which is the cause of oxidation.

Japanese Laid-Open Patent Publication No. 15154/1986 discloses polishing an amorphous silicon photosensitive material by using, as a toner for the amorphous silicon photosensitive material, the one obtained by adding, to the surfaces of the toner, silicon carbide having an average particle diameter of from 0.1 to 1 μm in an amount of from 0.005 to 5% by weight based on the toner.

Polishing the surface of the amorphous silicon photosensitive material Is surely effective in preventing the flow of image. However, there is no definite criterion in regard to what extent the surface be scraped off. When the surface is excessively polished, the charging performance is impaired and the life of the photosensitive material is shortened. When the amount of polishing is small, on the other hand, the image tends to flow making it difficult to stably form the image.

This problem similarly holds in exhausting ozone; i.e., excess of exhaust results in an increase in the cost of fans, energy cost, and cost of ozone-absorbing agent, and too weak exhaust permits image to flow.

SUMMARY OF THE INVENTION

The present inventors have discovered the fact that the flow of image can be effectively prevented when in the amorphous silicon photosensitive material, the degree of oxidation in the drum (the photosensitive material) surface and the degree of deposition of discharge products establish a predetermined relationship.

The object of the present invention therefore is to provide an electrophotographic method by using an amorphous silicon photosensitive material, which enables the life of the photosensitive material to be lengthened without permitting image to flow and makes it possible to stably obtain image for extended periods of time.

According to the present invention, there is provided an electrophotographic method using an amorphous silicon photosensitive material, which comprises mainly charging, exposing to image-bearing light, developing, charging before transfer, transferring and cleaning, wherein in such a condition that satisfy the following relations (1) and (2):

$$x \leqq 20 \quad (1)$$

$$y \leqq a \cdot \exp(-bx) \quad (2)$$

wherein x indicates a degree of oxidation in the surface of the photosensitive material (SiO/SiC), y indicates an amount of deposition of a discharge product generated by charging (mole/cm$^2$), a is a number $2.2\times10^{-9}$, and b is a number 2.0, an atmosphere around the photosensitive material is controlled and a surface of the photosensitive material is polished by the developing and the cleaning.

According to the present invention, it is desired that ozone which is generating during the main charging and during the charging before transfer is exhausted, and that surfaces of the photosensitive material are polished by using a toner blended with a polishing agent.

According to the present invention which sets the condition as expressed by the above-mentioned relations, the image flow can be prevented without the need of exhausting the atmosphere in which the photosensitive material is placed to an excess degree or without the need of polishing the surface of the photosensitive material to an excess degree. Therefore, the life of the photosensitive material is not shortened and great advantage is obtained in cost. According to the present invention, for instance, favorable image without image flow can be stably obtained up to more than 100,000 pieces of copies and, particularly, up to more than 1,000,000 pieces of copies.

BRIEF DESCRIPTION OF THE DRAWINGS

FIGS. 1(A)–1(E) are diagrams explaining the mechanism of image flow in an amorphous silicon photosensitive material;

DETAILED DESCRIPTION OF THE INVENTION

Figure 2:
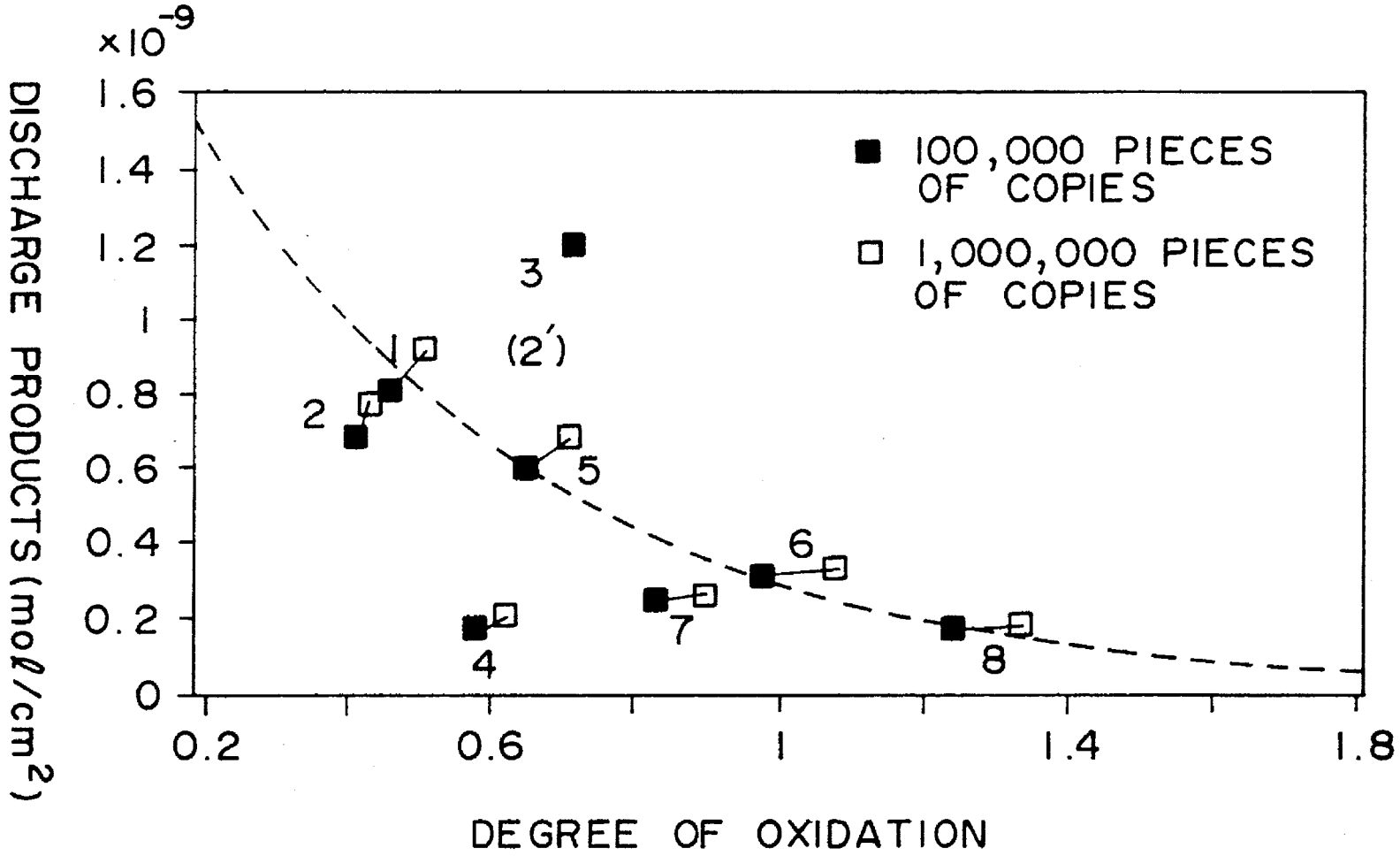
FIG. 2 is a graph plotting regions where image flow takes place, wherein the abscissa represents the degree of oxidation x in the surface of the photosensitive material and the ordinate represents the amount y of deposition of discharge products.

The present inventors have studied the cause of image flow that occurs in the electrophotographic method using amorphous silicon photosensitive material and have postulated that the surface of the drum is oxidized with ozone, the surface layer becomes electrically conducting when it absorbs water in excess amounts, and electrically conducting property is promoted when the discharge products dissolve in the water.

Based on this postulation, therefore, a contact angle of the drum surface relative to the water was studied as a scale for measuring hydrophilic property in the drum surface. With the above contact angle, however, there was obtained no significant correlation between the image flow and the contact angle. Next, a correlation was studied between the amount of water absorbed by the surface of the drum and the image flow. However, the amount of water absorbed by the surface of the drum was so small that there was obtained no significant correlation.

In the amorphous silicon photosensitive material, it is presumed that the mechanism of generating the image flow is as shown in FIGS. 1(A)–1(E). That is, referring to FIG. 1(A), a representative amorphous silicon photosensitive material 31 that is generally used has an amorphous silicon photosensitive layer 3 formed on an electrically conducting substrate (aluminum drum) 32 in a state where it has not been used. The photosensitive layer 3 comprises a body (intermediate layer) 34 of a-Si:H:B, a surface layer 35 of a-SiC:H, and a lower layer 36 of a-Si:H:B:O.

Referring to FIG. 1(B) illustrating the process of oxidation in the surface of the drum, ozone ($O_3$) generated by electric discharge oxidizes the surface of the drum as represented by the following formula (3)

$$O_3+Si \rightarrow O_2+O+Si \rightarrow O_2+SiO \quad (3)$$

Then, referring to FIG. 1(C) illustrating the hygroscopic process, SiO on the surface of the drum exhibits high hygroscopic property and absorbs water, so that the surface exhibits adsorptive property.

in FIG. 1(D) illustrating the process of adsorbing discharge products, products formed by corona discharge, i.e., NOx, SOx, $NH_3$ and the like dissolve in the water in the surface of the drum causing the electrically conducting properly to be enhanced.

In FIG. 1(E) showing the final image flow, when there exists an electrically conducting water film during the charging, the electric resistance decreases in the surface permitting the latent image to flow.

Based upon this postulation, the present inventors have estimated that the degree of oxidation (SiO/SiC)x in the surface of the amorphous silicon photosensitive material and the amount of deposition of discharge products (mol/cm$^2$)y greatly affect the image flow, and have eagerly conducted experiments to obtain the following interesting results.

In the present invention, the oxidation degree (SiO/SiC)x in the surface of the photosensitive material is a ratio of SiO and SiC in the surface of the photosensitive material found in compliance with ESCA (electron spectroscopy for chemical analysis, X-ray photoelectron spectroscopic method), and the amount of deposition of discharge products (mol/cm$^2$)y is a value obtained by wiping off the surface of the photosensitive material with pure water and subjecting it to the ion chromatography.

FIG. 2 is a graph plotting regions where image flow takes place, wherein the abscissa represents the degree of oxidation x in the surface of the photosensitive material and the ordinate represents the amount y of deposition of discharge products.

In FIG. 2, the amount y of deposition of limit discharge products that cause the image to flow is expressed by the following experimental formula (2')

$$y=a\cdot\exp(-bx) \quad (2')$$

wherein a is a number $2.2\times10^{-9}$ and b is a number 2.0.

The image flows in the regions above the curve (2').

FIG. 2 shows the following fact. That is, when the degree of oxidation (SiO/SiC)x is small in the surface of the photosensitive material, the allowable amount of deposition of discharge products (mol/cm$^2$)y is relatively large. However, the allowable amount of deposition of discharge products (mol/cm$^2$)y decreases with an increase in the degree of oxidation (SiO/SiC) in the surface of the photosensitive material.

In such a condition that the degree of oxidation (SiO/SiC)x in the surface of the photosensitive material and the amount of deposition of discharge products (mol/cm$^2$) satisfy the formulas (1) and (2), atmosphere around the photosensitive material is controlled, the photosensitive material is polished by the developing and cleaning. This makes it possible to extend the life of the photosensitive material without permitting image to flow and to stably obtain image for extended periods of time.

In order to adjust the degree of oxidation and the amount of deposition of discharge products according to the present invention, it is desired to exhaust ozone generated during the main charging and the charging before the transfer, and to polish the surface of the photosensitive material by using a developing toner blended with a polishing agent.

A corona charger is used for the main charging and for the charging before the transfer. During the charging, however, not only ozone is generated but also other products such as NOx, SOx, $NH_3$, etc. are generated due to corona discharge. Exhaust at the charging portion brings about double advantage; i.e., not only oxidation on the surface of the photosensitive material due to ozone is decreased but also deposition of the discharge products is prevented as well. It is desired that the total ozone concentration in the drum surface is not higher than 6 ppm and, particularly, not higher than 1 ppm.

Figure 3:
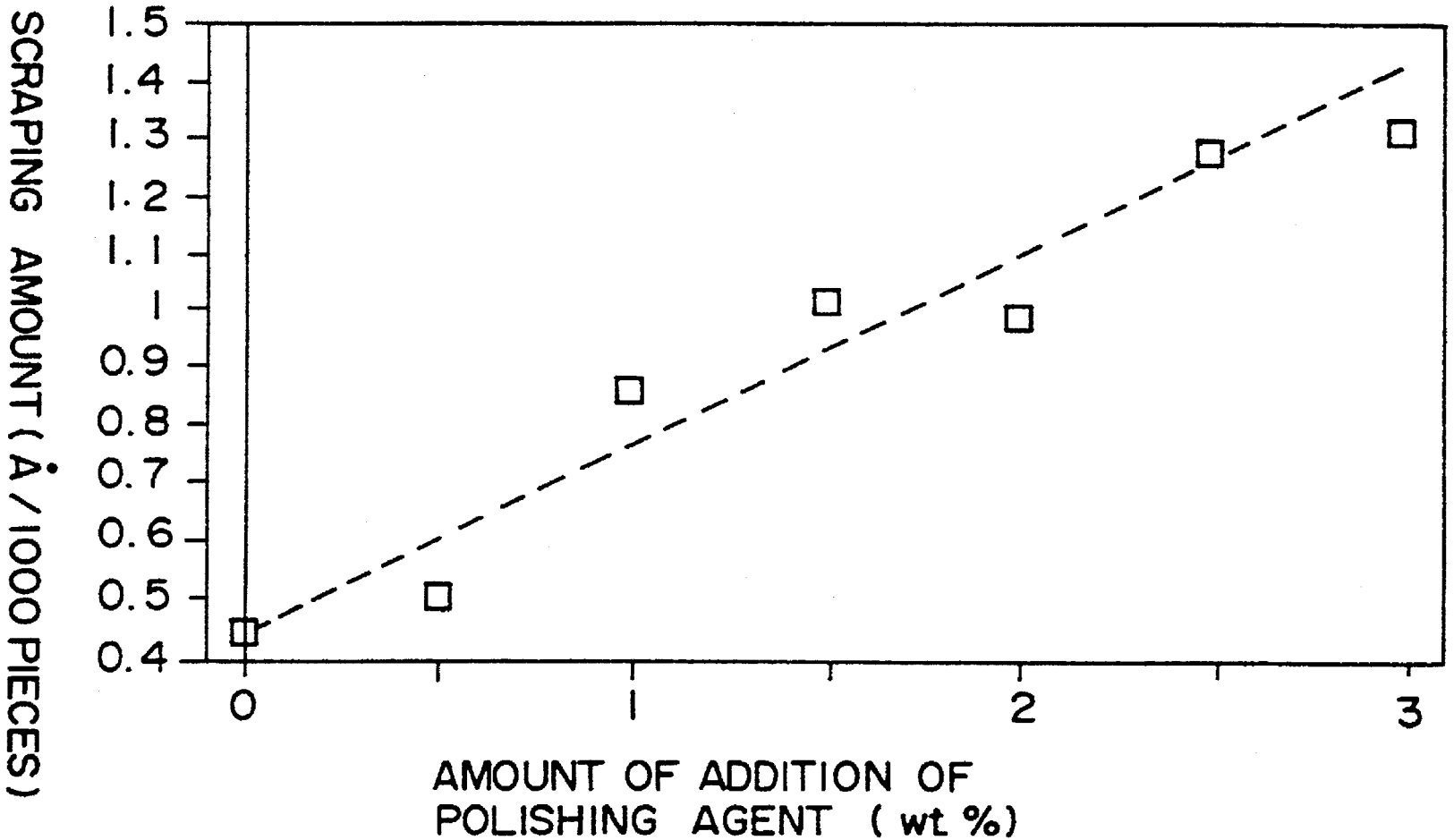
FIG. 3 is a graph plotting a relationship between the blending amount of a polishing agent (% by weight) based on the toner as represented by the abscissa and the scraping amount (Å/1000 pieces) of the surface of the photosensitive material as represented by the ordinate.

The rate of scraping the surface of the photosensitive material varies depending upon the kind of the polishing agent blended in the developing toner but usually depending upon the amount of the polishing agent that is blended. FIG. 3 is a graph plotting a relationship between the blending amount of the polishing agent (% by weight) based on to the toner as represented by the abscissa and the scraping amount (Å/1000 pieces) of the surface of the photosensitive material as represented by the ordinate. It will be understood from FIG. 3 that the amount of scraping the oxide film on the surface of the photosensitive material can be adjusted by adjusting the amount of blending the polishing agent.

According to the present invention, the degree of oxidation (SiO/SiC)x in the surface of the photosensitive material is so maintained as will not be smaller than 0.4 even after more than 100,000 pieces of copies are obtained, and whereby the life of the photosensitive material is extended without much increasing the load for the electrophotographic apparatus, such as fans or electric power required therefor, and without losing electrophotographic properties of the photosensitive material such as charging potential.

Figure 4:
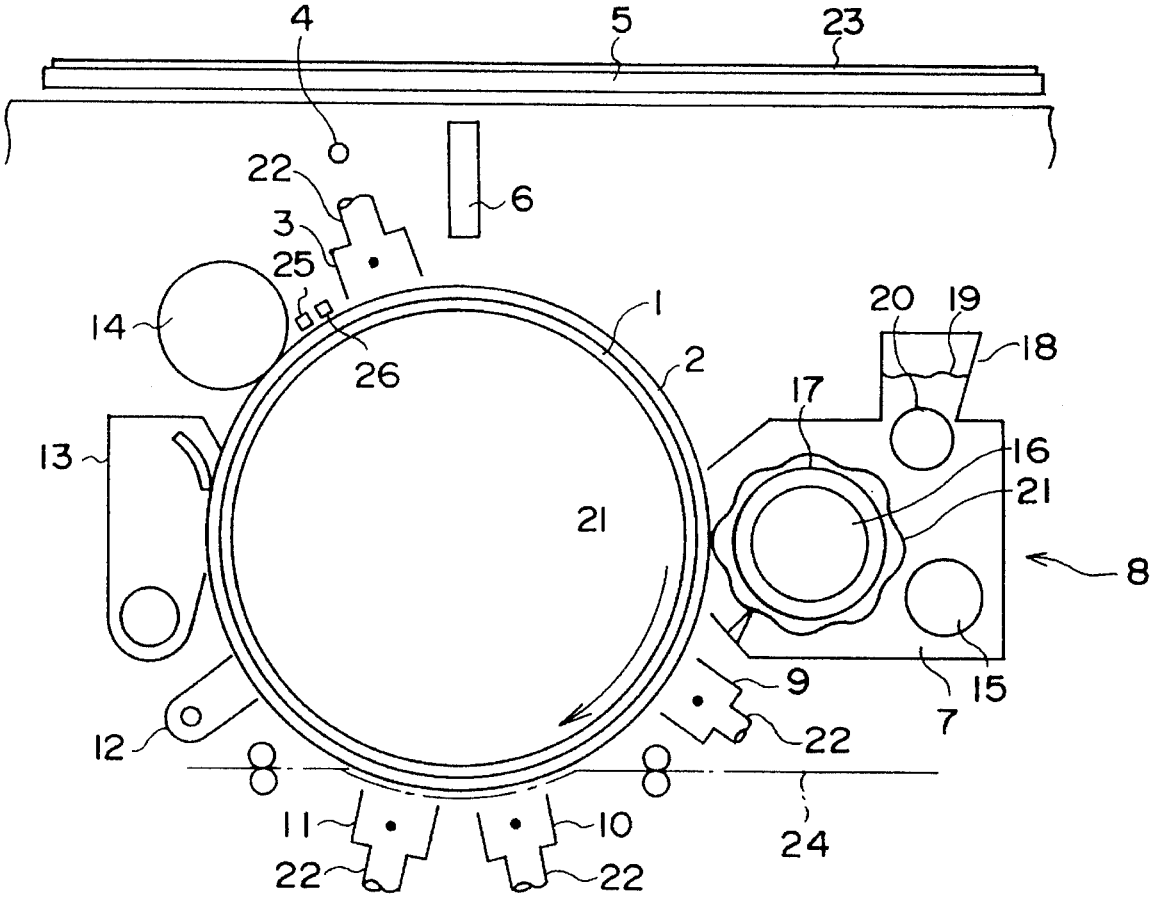
FIG. 4 is a diagram illustrating the constitution of the apparatus employed in the electrophotographic method of the present invention.

Referring to FIG. 4 illustrating an apparatus used for the electrophotographic method of the present invention, an amorphous silicon photosensitive layer 2 is provided on the surface of the metal drum 1 that is driven.

The drum is surrounded by a corona charger 3 for main charging; an image-exposing mechanism which includes a lamp 4, a transparent plate 5 for supporting the document and an optical system 6; a developing mechanism 8 having a developing agent 7; a corona charger 9 for charging before the transfer; a corona charger 10 for transferring the toner; a corona charger 11 for separating the paper; a discharging lamp 12; and a cleaning mechanism 13 in the order mentioned. As required, a mechanism 14 for heating the photosensitive material 2 may be provided between the cleaning mechanism 13 and the corona charger 3 for main charging.

The developing mechanism includes therein a developing agent stirrer mechanism 15, a developing sleeve 17 having a magnet 16 therein, and a hopper 18 for feeding developing toner. The hopper 18 for feeding developing toner contains the toner 19 to which the polishing agent is added, and feeds the toner 19 into the developing mechanism 8 using a toner feeding roll 20. The toner 19 fed into the developing mechanism 8 is mixed together with a magnetic carrier and is electrically charged to form a magnetic brush 21 on the developing sleeve 17, and is conveyed to a position of the photosensitive layer 2 where the magnetic brush 21 rubs the surface off the photosensitive layer 2 to develop the electrostatic latent image.

In order to lower the ozone concentration in the surface of the photosensitive layer 2, a discharge mechanism comprising a discharge duct 22 is provided for the corona charger 3 for main charging and for the corona charger 9 for charging before the transfer and, as required, for the corona charger 10 for transferring the toner and/or the corona charger 11 for separating the paper.

The process for forming image using the above electrophotographic apparatus will now be briefly described. First, the photoconducting layer 2 is electrically charged by the corona charger 3 into a predetermined polarity (usually positive polarity). Then, a document 23 to be copied is illuminated with a lamp 4, and the a-Si photoconducting layer 2 is exposed to a light-ray image of the document through the optical system 6 thereby to form an electrostatic latent image that corresponds to the document image. The electrostatic latent image is visualized by the developing mechanism 8 to form a toner image.

In order to improve the toner transfer efficiency on the photosensitive layer 2, the electric charge is removed by using the corona charger 9 for charging before the transfer. The electric charge is usually removed by using alternating current (AC) corona. Ozone is most likely to be generated during the charging by the corona charger 9 for charging before the transfer and, hence, it is particularly important to exhaust the atmosphere near the corona charger 9 for charging before the transfer.

A transfer paper 24 is fed at a position of the charger 10 for transferring the toner so as to come into contact with the surface of the drum, and the corona charging of the same polarity as the electrostatic image is effected from the back surface of the transfer paper 24 to transfer the toner image onto the transfer paper 24. The transfer paper 24 onto which the toner image is transferred is electrostatically separated from the drum as the electric charge is removed by the corona charger 11 for separation, and is sent to a processing zone such as a fixing zone (not shown). After the toner is transferred, the residual electric charge in the photoconducting layer 2 is removed by being exposed over the whole surface to the light from the discharging lamp 12. The residual toner is then removed by the cleaning mechanism 13.

Any amorphous silicon photosensitive layer that has heretofore been known can be used. In general, there can be used an amorphous silicon photosensitive layer that is precipitated on an electrically conducting substrate such as an aluminum blank tube by the plasma decomposition of a silane gas. The amorphous silicon photosensitive layer may be doped with hydrogen, halogen or the like, or may further be doped with an element of the Group III or the Group V of periodic table.

From the standpoint of Anti-oxidation, the surface layer of the amorphous silicon photosensitive layer should exist in the form of SiC, and a three-layer structure shown in FIG. 1(A) is best suited. The whole thickness of the amorphous silicon photosensitive layer may range from 20 to 100 μm and, particularly, from 25 to 90 μm, and the thickness of the SiC surface layer may range from 0.2 to 1 μm and, particularly, from 0.3 to 0.8 μm. When a lower barrier layer is provided, its thickness may range from 0.5 to 5 μm and, particularly, from 1 to 3 μm.

A representative amorphous silicon photosensitive material has physical properties, i.e., dark electric conductivity of $\leqq 10^{-12}\Omega^{-1}\cdot cm^{-1}$, activation energy of <0.85 eV, photoelectric conductivity of $>10^{-7}\Omega^{-1}\cdot cm^{-1}$, optical band gap of 1.7 to 1.9 eV, and the amount of bonded hydrogen of 10 to 20 atomic %, and the film thereof has a dielectric constant of from 11.5 to 12.5.

The amorphous silicon photosensitive material can be charged into positive polarity or negative polarity depending upon the kind of element with which it is doped. From the standpoint of decreasing as small as possible, the amount of ozone that is generated, however, it is desired that the amorphous silicon photosensitive material is charged into positive polarity. It is desired that the charged potential on the surface of the amorphous silicon photosensitive material is from 300 to 1000 volts and, particularly, from 400 to 900 volts. For this purpose, it is desired that the voltage applied to the corona charger for main charging is from 4 to 10 KV and, particularly, from 5 to 8 KV.

The developing agent used for the electrophotography of the present invention will be a one-component-type magnetic developing agent or a two-component-type magnetic developing agent. As the former developing agent, there can be used any known developing agent in which the toner particles are blended with a magnetic powder and as the latter developing agent, there can be used any known developing agent comprising an electroscopic Loner and a magnetic carrier.

As the toner, for instance, there can be used a coloring toner having electroscopic property and fixing property, which generally comprises a granular composition having particle diameters of from 5 to 30 microns obtained by dispersing coloring pigments, charge control agents and the like in a binder resin.

As the binder resin which is the toner component, there can be used a thermoplastic resin, or an uncured thermosetting resin or a thermosetting resin of an initial condensate. Its examples include aromatic vinyl resin such as polystyrene, styrene/acrylic copolymer resin, acrylic resin, polyvinyl acetal resin, polyester resin, epoxy resin, phenol resin, petroleum resin, olefin resin, etc.

As the coloring pigment, there can be used carbon black, cadmium yellow, molybdenum orange, Pyrazolone Red, Fast Violet B, and Phthalocyanine Blue in one kind or in two or more kinds.

As the charge control agent, there can be used an oil-soluble dye such as Nigrosine base (CI 50415), oil black (CI 26150), spiron black, metal complex salt dye, metal naphthenate, soap of a fatty acid metal, soap of resin acid, etc.

In the case of the one-component-type magnetic toner, the magnetic powder to be contained in the toner particles will be a widely known magnetic powder such as tri-iron tetroxide (magnetite), ferrites, magnetic metal, etc.

The magnetic powder has an average particle diameter of generally from 0.1 to 10 μm and, particularly, from 0.1 to 1 μm. Furthermore, the content of the magnetic powder in the toner may be from 20 to 80% by weight and, particularly, from 30 to 60% by weight per the whole toner.

In the case of the two-component-type magnetic developing agent, on the other hand, the magnetic carrier used in combination with the toner will be any one of tri-iron tetroxide (magnetite), ferrites, iron powder or the like that has been widely known.

The magnetic carrier has an average particle diameter of generally from 20 to 200 μm and, particularly, from 40 to 130 μm, and may further have a saturation magnetization of from 30 to 70 emu/g and, particularly, from 40 to 50 emu/g as measured at 50 KOe.

It is desired that the surfaces of the magnetic carrier have been coated with a resin. With the magnetic carrier being coated with the resin, the optimum developing state can be maintained for extended periods of time and strikingly increased number of pieces of copies can be obtained.

As the resin for coating the magnetic carrier, there can be used acrylic resin, styrene-acrylic resin, acryl-modified silicone resin, silicone resin, epoxy resin, rosin-modified phenol resin, formalin resin, cellulose resin, polyether resin, styrene-butadiene resin, polyurethane resin, polyvinyl formal resin, melamine resin, polycarbonate resin, and fluorine-containing resin such as ethylene tetrafluoride in one kind or in a combination of two or more kinds.

It is desired that the resin component is used in an amount of from 0.1 to 10 parts by weight and, particularly, from 0.2 to 5 parts by weight per 100 parts by weight of the carrier core material.

In the above-mentioned two-component-type developing agent, the toner concentration may be so selected that the weight ratio of the carrier to the toner is from 99:1 to 90:10 and, particularly, from 98:2 to 94:6.

In the developing agent of any type of the present invention, use is made of the toner to which a polishing agent is added.

Among the polishing agents, those known polishing agents having an average particle diameter of from 0.1 to 5 μm and, particularly, from 0.15 to 1 μm are preferably used. It is desired that these polishing agents have Mohs' hardness of generally from 5 to 10.

Preferred examples of the polishing agent are not limited to the above-mentioned ones but further include oxide ceramics such as alumina ($Al_2O_3$), zirconia ($ZrO_2$), mullite ($3Al_2O_3.2SiO_2$), cordierite ($2MgO/2Al_2O_3/5SiO_2$), titania ($TiO_2$), steatite ($MgO_2.SiO_2$), silica, silica alumina, and the like; carbide ceramics such as silicon carbide ($SiC_2$), tungsten carbide (WC), zirconium carbide (ZrC), and the like; nitride ceramics such as boron nitride (BN), titanium nitride (TiN), silicon nitride ($Si_3N_4$) and the like; boride ceramics such as zirconium boride ($ZrB_2$), titanium boride ($TiB_2$) and the like; silicate ceramics such as tungsten silicate ($WSi_2$), molybdenum silicate ($MoSi_2$) and the like, diamond, corundum, chromium oxide, cerium oxide, and the like.

The amount of the polishing agent added to the toner varies depending upon the kind of the polishing agent and cannot be definitely determined but may, generally, be determined through experiment from the range of 0.1 to 10% by weight and, particularly, from the range of 0.5 to 5% by weight, so that an optimum scraping amount is obtained. That is, the relationship is found between the added amount of the polished agent and the scraping amount for each of the polishing agents as shown in FIG. 3, from which the amount of the polishing agent can be determined so that an optimum scraping amount (degree of oxidation in the surface of the photosensitive material) is obtained.

Developing with the one-component-type developing agent or with the two-component-type developing agent can be carried out by using a magnetic brush. In this case, the developing may be effected under a condition where the magnetic brush is brought into intimate contact with the surface of the photosensitive material, or may be effected under a condition where there exists a tiny gap between the magnetic brush and the surface of the photosensitive material and the toner flies from the magnetic brush to the surface of the photosensitive material.

In this case, a bias voltage for developing can be applied across the developing sleeve and the surface of the photosensitive drum. The bias voltage usually corresponds to a white-paper voltage of the photosensitive material, and is from about 50 to about 400 V in the case of the amorphous silicon photosensitive material. In establishing the above-mentioned flying phenomenon, an AC voltage may be superposed to impart vibration to the toner.

The electric charging before the transfer can be carried out by applying an AC voltage of, generally, 3 to 10 KV and, particularly, from 3.5 to 7 KV to the charger.

The voltages applied to the charger for transferring the toner and to the charger for separating the transfer paper, may lie within widely known ranges.

The amount of deposition of discharge products on the surface of the photosensitive material can be considerably decreased by effecting the exhaust as described above, which, however, is greatly affected by another environmental factor, i.e., temperature near the surface of the photosensitive material. That is, the amount of deposition of discharge products decreases with an increase in the temperature on the surface of the photosensitive material. The temperature can generally be from 35° to 60° C. Though not usually needed, it is allowable to provide a mechanism for heating the surface of the photosensitive material. The heating mechanism effectively works in preventing the flow of image caused by absorption of moisture in the earlier period of operation of the electrophotographic apparatus in which the temperature of the apparatus is low. The heating mechanism may be turned off when the temperature in the apparatus is raised, as a matter of course.

The amount of deposition of discharge products on the surface of the photosensitive material affects the electric resistance of the surface of the photosensitive material. By utilizing this fact, therefore, the surface resistance is detected and the heating mechanism 14 is turned on or off by providing a surface resistance sensor 25 and a temperature sensor 26 on the surface at an end of the photosensitive drum 2.

EXAMPLE

The invention will now be described by way of the following Example.

By using the Following copying machine and the developing agent, 100,000 pieces of copies and 1,000,000 pieces of copies were obtained continuously by changing the developing conditions in a variety of ways.

Copying machine: DC-7085 modified machine, produced by Mita Kogyo K.K. (having a structure as shown in FIG. 4).

Developing agent: Two-component-type magnetic developing agent comprising a ferrite carrier and a toner. The toner contains alumina ($Al_2O_3$) as a polishing agent.

Developing conditions: The drum surface was maintained at 45° C., and the main charging was effected by scorotron charging (positive charging).

In carrying out the copying operation, the amount of discharge from the back surface of the corona chargers provided along the circumference of the photosensitive drum and the amount of the polishing agent blended in the toner were changed in a variety of ways. After 100,000 pieces of copies and 1,000,000 pieces of copies were obtained, the degree of oxidation (SiO/SiC) In the surface of the photosensitive drum and the amount of deposition of discharge products were measured according to the methods described above, and the flow of image was observed by naked eyes. The results were as shown in Table 1 and FIG. 2.

After 100,000 pieces of copies and 1,000,000 pieces of copies were obtained, furthermore, total ozone concentrations in the surface of the photosensitive drum were measured. Table 1 shows the results together with the amounts of the polishing agent added to the toner.

Total ozone concentrations were found by inserting a tip of a hose in a gap between each of the chargers and the drum, the hose being connected to an ozone concentration meter, measuring the ozone concentrations at the portions where the chargers are provided, and adding them up together.

It will be understood from FIG. 2 that the image is not flowing in a region represented by the aforementioned formula (2).

TABLE 1

| Experiment No. | $O_3$ concentration (total) ppm | Amount of polishing agent wt. % | After 100,000 pieces of copies: Degree of oxidation Si—O/Si—C | After 100,000 pieces of copies: Amount of discharge products mol/cm$^2$ | After 100,000 pieces of copies: Flow of image | After 1,000,000 pieces of copies: Degree of oxidation Si—O/Si—C | After 1,000,000 pieces of copies: Amount of discharge product mol/cm$^2$ | After 1,000,000 pieces of copies: Flow of image |
|---|---|---|---|---|---|---|---|---|
| 1 | 0.1 | 0 | 0.46 | $8.00 \times 10^{-10}$ | ○ | 0.51 | $9.1 \times 10^{-10}$ | X |
| 2 | 0.1 | 0.1 | 0.41 | $6.8 \times 10^{-10}$ | ○ | 0.43 | $7.70 \times 10^{-10}$ | ○ |
| 3 | 0.8 | 0 | 0.72 | $1.20 \times 10^{-9}$ | X | | | |
| 4 | 0.8 | 1.5 | 0.58 | $1.80 \times 10^{-10}$ | ○ | 0.62 | $2.00 \times 10^{-10}$ | ○ |
| 5 | 2.4 | 0.1 | 0.65 | $6.00 \times 10^{-10}$ | ○ | 0.71 | $6.80 \times 10^{-10}$ | X |
| 6 | 5.9 | 0.1 | 0.98 | $3.10 \times 10^{-10}$ | ○ | 1.08 | $3.32 \times 10^{-10}$ | X |
| 7 | 5.9 | 2.5 | 0.83 | $2.50 \times 10^{-10}$ | ○ | 0.9 | $2.66 \times 10^{-10}$ | ○ |
| 8 | 15 | 5 | 1.25 | $1.80 \times 10^{-10}$ | ○ | 1.34 | $1.90 \times 10^{-10}$ | X |

○: yes
X: no

We claim:

1. In an electrophotographic method which comprises the steps of subjecting an amorphous silicon photosensitive material to main charging, imagewise exposure, development, pre-charging before transfer and transferring; wherein said main charging and said pre-charging before transfer generate ozone, which causes oxidation of the surface of the photosensitive material, and discharge products, which adhere to the surface of the photosensitive material; the improvement comprising:

said steps being carried out while abrading the surface of the photosensitive material by development with a developing toner containing an abrading material and exhausting ozone at the time of main charging and pre-charging before transfer so that x, the degree of oxidation (SiO/SiC) of the surface of the photosensitive material, and y, the amount of discharge products (mole/cm$^2$) adhering to the surface of the photosensitive material, satisfy the following relationships (1) and (2)

$$0.4 \leqq x \leqq 1.25 \quad (1)$$

$$y \leqq 2.2 \times 10^{-9} \cdot \exp(-2.0x) \quad (2);$$

and wherein said abrading material is at least one abradant selected from the group consisting of alumina, zirconia, mullite, cordierite, titania, steatite, silica, silica-alumina, silicon carbide, tungsten carbide, zirconium carbide, boron nitride, titanium nitride, silicon nitride, zirconium boride, titanium boride, tungsten silicide, molybdenum silicide, diamond, corundum, chromium oxide and cerium oxide.

2. The electrophotographic method according to claim 1, wherein $$y \geqq 1.80 \times 10^{-10} \text{ mole/cm}^2.$$

* * * * *